US007125158B2

(12) United States Patent
Zonta

(10) Patent No.: US 7,125,158 B2
(45) Date of Patent: Oct. 24, 2006

(54) LAMP HOLDER FOR WIRELESS LAMPS WITH QUICK SOCKET AND RELATIVE LAMP

(76) Inventor: Lino Zonta, Via G. di Vittorio, No. 30 I-30029, S. Stino di Livenza (IT)

( * ) Notice: Subject to any disclaimer, the term of this patent is extended or adjusted under 35 U.S.C. 154(b) by 0 days.

(21) Appl. No.: 11/045,599

(22) Filed: Jan. 28, 2005

(65) Prior Publication Data

US 2005/0170706 A1 Aug. 4, 2005

(30) Foreign Application Priority Data

Jan. 30, 2004 (IT) ..... PD2004A0030

(51) Int. Cl.
*H01R 33/00* (2006.01)
*H01R 33/02* (2006.01)

(52) U.S. Cl. ..... 362/649; 362/655; 362/260; 439/226

(58) Field of Classification Search ..... 362/655–658, 362/260, 649; 439/226, 242–243
See application file for complete search history.

(56) References Cited

U.S. PATENT DOCUMENTS 4,084,873 A * 4/1978 Grate ..... 439/244
6,309,236 B1 * 10/2001 Ullrich ..... 439/226

* cited by examiner

*Primary Examiner*—Ali Alavi
(74) *Attorney, Agent, or Firm*—Serafini Associates; Franco A. Serafini

(57) ABSTRACT

A lamp (L) having tubular end contacts (L1) adapted for insertion into opposite lamp holders (P), each lamp holder (P) having a body (S) in an insulating material and a contact element (C) shaped to provide a seat for the lamp contact (L1). In one embodiment, the seat comprises a cylindrical central portion (C1) positioned between flexible opposite arched walls (C2) with two upper divergent flanges (C2*a*). The lamp end contacts (L1) are positioned between the flexible arched walls (C2) of the contacts (C), in order to receive the cylindrical parts (C1) of the seats of the contact elements (C) inside the end contacts (L1) of the lamp (L). By the rotation of the lamp (L) around the cylindrical parts (C1) of the contact elements (C), an unwanted removal of the lamp (L) from the lamp holders (P) is prevented.

5 Claims, 1 Drawing Sheet

LAMP HOLDER FOR WIRELESS LAMPS WITH QUICK SOCKET AND RELATIVE LAMP

BACKGROUND OF THE INVENTION

1. Field of the Invention

This present invention relates to the field of wireless lamps with an electric contact at each end. More particularly, the present invention relates to lamps having a quick release from the lamp holder.

2. Description of Related Art

Wireless lamps having an electric contact at each end are known in the art. In particular, halogen wireless lamps are widely used due to both their high brilliancy and their small dimensions.

Halogen lamps with a contact at each end, from now on briefly referred to as lamps, have the electric contact at each end that includes a hollow metallic seat connected to an internal filament.

Lamp holders for said lamps, used coupled and opposite, are made of a support, realized in an insulating material, typically a ceramic material, and comprise a foil provided at one end with a semi-spherical relief fit for being positioned into the hollow seat of the lamp contact. Each foil is then connected with one of the electric feed poles.

The insertion of said lamps between the two lamp holders is simply performed by positioning a contact of the lamp on the contact of a lamp holder, pushing the lamp contact in such a way as to flex the foil enough and to exactly achieve an corresponding contact of the lamp on the other lamp holder.

The lamp is held in position simply by the pressure of the two foils of the two lamp holders, and by the corresponding semi-spherical relieves, on the hollow contacts of the lamp.

The lamps and relative lamp holders thus realized are simply to manufacture and, moreover, the application of such lamps on the lamp holders is quick and simple.

However, said lamps and relative lamp holders have also a number of drawbacks.

The lamps, in particular halogen lamps, produce a large amount of heat that is transmitted to the lamp holders and to the foils of the contacts. Because of the heat, and because of different lamp changeovers, the foils lose their elastic ability to bend, thus enlarging and holding the lamp only partially.

Further, if the lamp is not inserted properly into the lamp holder, because of the heat of the lamp itself or because of movements of the lamp, a hollow end contact of the lamp and a relieved contact of the foil of the lamp holder cannot be properly aligned, thus causing a consequent overheating and oxidation of the contacts and an electric arc between the two contacts.

Still further, if the foils cannot hold the lamps with enough strength, possible crashes, bumps or alike can cause the release of the lamp with the possibility of an explosion, burns on the user, or other damages.

SUMMARY OF THE INVENTION

In order to overcome to the above cited drawbacks, a new lamp and a related lamp holder with safety contacts has been studied and carried out. The invention concerns a new linear lamp and a related lamp holder.

The invention finds applications for any kind of linear lamps in the field of sun tanning, and also for civil and industrial uses in the field of lightning.

It is a feature of the present invention to prevent the undesired release, fall, or detachment of a lamp from the lamp holder.

It is another feature of the present invention to provide a continuous and optimum contact between the electric contacts of the lamp holder and the electric contacts of the lamp.

It is another feature of the present invention to facilitate and provide for a quick insertion of the lamp in the lamp holder and for a quick release of the lamp holder.

It is another feature of the present invention not to allow the use of lamps with different sockets or contacts on a holder for lamps according to the present invention, and also not to allow the use of a lamp according to the present invention on the lamp holders according to the prior art.

These and other direct and complementary features are achieved by a lamp and lamp holder for lamps according to the present invention by providing a lamp with hollow contacts mating a tubular element in the lamp holder, wherein the lamp holder comprises a support made of a body in an electrically-insulating material and a contact element in a conductive material.

In one embodiment, the body of the lamp holder is manufactured from an insulating material that resists heat. Said body typically has a plurality of spaces or chambers, one of which is fit for receiving the contact element, at least one of which is fit for receiving a fixing element of the lamp holder, and where at least one hole or space or chamber is defined within the body for the passing or the fixing of the conductor cable.

The contact element is preferably made from a material suited for electrical contact, typically a metallic material, and may be shaped and bent in a such way to define a seat, for the contact of the lamp; with a cylindrical shape and a circular or circle-arc shaped cross-section flanked by two diametrically opposed arched walls having edges that are radially divergent with respect to the cylindrical central portion.

The lamp comprises end contacts made of an electrically-conducting material that are substantially shaped as cylinders, with a semi-circular section, coaxial with the lamp itself and each having an opening that extends parallel to its axis.

The lamp is inserted in the lamp holder so that the lateral opening of a cylindrical contact is directed towards the cylindrical part of the contacts on the opposite lamp holder, and so that said contact of the lamp wraps said cylindrical contact of the lamp holder, passing through the external arched walls of the lamp holder.

The rotation by half a turn of the lamp around the axis of the contacts directs the contacts of the lamp towards the inner portion of each lamp holder, securing the lamp to the lamp holders even in the event of crashes, vibrations or similar stresses, while, in of the event of a breaking of the lamp, the contacts remain attached to the lamp holder.

In this embodiment, the electric contact between the lamp and each lamp holder is assured both by the central cylindrical part of the lamp holder, and by the two opposite arched walls of the lamp holder.

DETAILED DESCRIPTION OF THE PREFERRED EMBODIMENT

The characteristics of the new lamp holder for lamps and relative lamp with safety contacts will be clarified by the following description, referring to the figures attached as a non-limiting example.

The body (S) is made of an electrically insulating material resistant to heat, the body (S) having many spaces or chambers (S1, S2, S3). At least one of said spaces or chambers (S1) is fit for receiving the contact element (C). Other spaces or chambers (S2, S3) are fit for receiving, respectively, an element (F1) for affixing the lamp holder (P) to a supporting structure, and the conductor cable (E) to the contact element (C).

Figure 3:
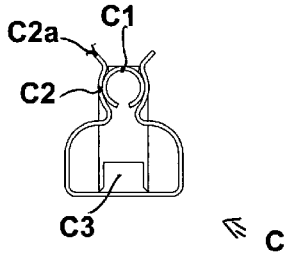
FIG. 3 is another front elevation view of the contact element of the present invention.
Figure 4:
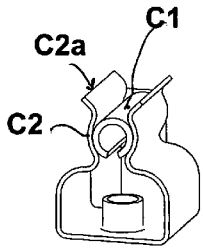
FIG. 4 is a perspective view of the contact element of the present invention.

The contact element (C), represented in front view and in perspective view in FIGS. 3 and 4, is made of a metallic material for electric contacts, and it is shaped and bent in such a way to provide a seat for the contact (L1) of the lamp (L).

Said seat comprises a substantially cylindrical central portion (C1) around which there are two opposite arched walls (C2). The central portion (C1) has a section shaped as a circle or as a circle-arc, while the two arched walls (C2) are positioned laterally and diametrically opposite to said central portion (C1).

In particular, said two arched walls (C2) are partially flexible, or enlargeable, in order to allow the passage of the lamp contact (L1). Further, said two arched walls (C2) have two upper divergent flanges (C2*a*), in order to facilitate and drive the insertion of lamp contact (L1). Other parts and/or complementary portions (C3) of the contact element (C), properly shaped, provide for the connection of the contact element (C) to the box-shaped body (S), and for the connection of the conductor cable (E) with the contact element (C).

Figure 2:
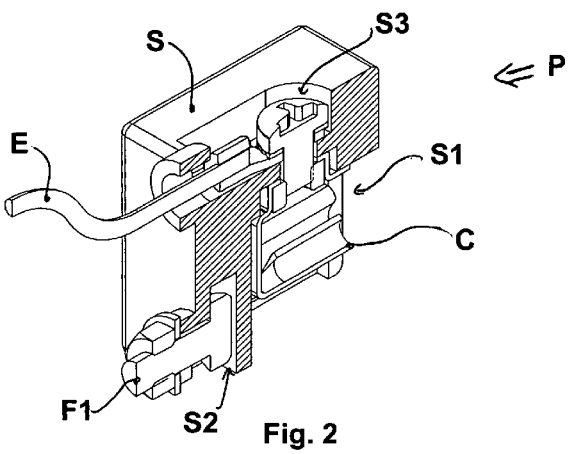
FIG. 2 is a sectional and perspective view of the new lamp holder (P), mainly comprising a body (S) and a contact element (C).
Figure 5:
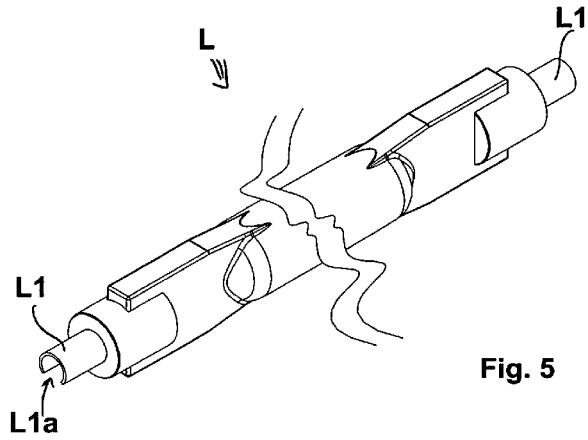
FIG. 5 is a perspective view of the lamp and contacts of the present invention.
Figure 1:
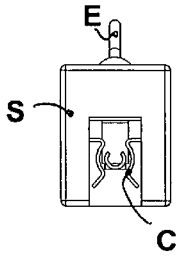
FIG. 1 is a front elevation view.

Turning now to FIG. 5, there is shown a prospective view of the lamp (L) with safety contacts (L1).

Typically, each end contact (L1) of the lamp (L) is made of an element in electro-conducting material suitable for electric contacts, substantially shaped as a cylinder, with a lateral opening (L1*a*) parallel to the contact axis (L1). Said lateral opening (L1*a*) is wide enough to enable the insertion through said lateral opening (L1*a*) of the central cylindrical part (C1) of the seat of the contact element (C).

The application of the inventive lamp (L) with safety contacts (L1) between two new opposite lamp holders (P) is realized by inserting the end contacts (L1) of the lamp (L) between the external arched walls (C2) of the two opposite lamp holders (P), in such a way that each of said lamp contact (L1) wraps the cylindrical contact (C1) of the lamp holder (P).

The rotation by half a turn of the lamp (L) around the longitudinal axis of the contacts (L1) directs said contacts (L1) towards the inner portion of the lamp holder (P). This way, the lamp (L) is held in position by the lamp holder (P) even in the event of vibrations or similar stresses.

The electric contact between lamp (L) and lamp holder (P) is assured both by the central cylindrical part (C1) and by the two opposite arched walls (C2) of the lamp holder (P).

With reference to the above description the following claims are put forth.

I claim:

1. A lamp comprising:

an enclosure adapted to generate a light; and first and a second terminal posts extending from the enclosure, the first and the second terminal posts each having a hollow tubular structure, wherein the first and second terminal posts have a substantially common longitudinal axis and are each electrically conductive, wherein the first and second terminal posts are each supported by a lamp holder, the lamp holder comprising an electrically conductive tubular element, wherein the hollow tubular structure includes a longitudinal opening of sufficient latitudinal width to enable the insertion of the tubular element in a mating coaxial position, and wherein the insertion of the tubular element in a mating coaxial position enables the transmission of electricity between the tubular element and the terminal post.

2. The lamp of claim 1, wherein the tubular element is lodged within a holder having flexible, substantially parallel walls, and wherein the hollow tubular structure is retained in the mating coaxial position by the pressure exercised by the flexible, substantially parallel walls on the hollow tubular structure.

3. The lamp of claim 2, wherein the flexible, substantially parallel walls are electrically conductive.

4. The lamp of claim 2, wherein the flexible, substantially parallel walls have opposite and divergent ends, in order to facilitate the insertion of the tubular element in the mating coaxial position.

5. The lamp of claim 2, wherein the holder is structured to enable a rotation of the tubular structure around the tubular elements, thereby preventing a release of the tubular structure from the tubular element by a non-rotational force applied on the lamp after the rotation.

* * * * *